United States Patent [19]

Rehrl et al.

[11] Patent Number: 4,725,056

[45] Date of Patent: Feb. 16, 1988

[54] LEG STABILIZATION FOR A TRUNK EXTENSION/FLEXION TEST, REHABILITATION AND EXERCISE MACHINE

[75] Inventors: George F. Rehrl, Central Islip; Howard J. Solow, Nesconset, both of N.Y.

[73] Assignee: Lumex, Inc., Bay Shore, N.Y.

[21] Appl. No.: 802,523

[22] Filed: Nov. 27, 1985

[51] Int. Cl.[4] ..... A63B 21/00

[52] U.S. Cl. ..... 272/134; 272/144; 272/DIG. 4; 272/143; 128/25 R

[58] Field of Search ..... 272/73, 125, 130, 134, 272/116, 129, 144, 145, 143; 128/80, 25 R, 25 B, 165, 74, 779, 782; 403/104; 269/322, 328

[56] References Cited

U.S. PATENT DOCUMENTS

| | | | |
|---|---|---|---|
| 3,463,146 | 8/1969 | Schwartz et al. . | |
| 4,022,463 | 5/1977 | Scott, Jr. . | |
| 4,167,352 | 9/1979 | Pletsher | 403/104 |
| 4,247,098 | 1/1981 | Brentham | 272/134 X |
| 4,291,229 | 9/1981 | Patt | 269/328 X |
| 4,322,071 | 3/1982 | Lambert, Jr. et al. . | |
| 4,349,193 | 9/1982 | Lambert, Jr. et al. . | |
| 4,349,195 | 9/1982 | Johnston . | |
| 4,390,015 | 6/1983 | Clements | 269/328 X |
| 4,462,252 | 7/1984 | Smidt | 272/134 X |
| 4,465,368 | 1/1986 | Boettcher | 272/125 X |
| 4,478,411 | 10/1984 | Baldwin | 272/134 X |
| 4,586,495 | 5/1986 | Petrofsky | 128/782 X |
| 4,600,196 | 7/1986 | Jones | 272/134 |

FOREIGN PATENT DOCUMENTS 635999 12/1978 U.S.S.R. .

OTHER PUBLICATIONS

Athletic J. vol. 55, No. 4, Dec. 1974, pp. 15,26,28,30, 31 and 77–80.

"Quantitative Assessment of Back Strength Using Isokinetic Testing" *Spine*, vol. 9, No. 3, 1984 (287–290).

*Primary Examiner*—Richard A. Apley
*Assistant Examiner*—Howard Flaxman
*Attorney, Agent, or Firm*—Davis Hoxie Faithfull & Hapgood

[57] ABSTRACT

A leg stabilization apparatus for a trunk extension/flexion test, rehabilitation and exercise machine wherein a person secured to an input assembly of the machine engages in trunk extension/flexion motion. The apparatus comprises a popliteal pad assembly, a thigh-knee pad assembly and a tibia pad assembly. The popliteal pad assembly has two popliteal pads which bear against the back of the person's knees. The height of the popliteal pad assembly is adjustable. The thigh-knee pad assembly has two thigh pads which bear against the person's thighs and two knee pads which bear against the inside of the legs at the knees. The tibia pad assembly has two tibia pads which bear against the tibia. Both the thigh-knee pad assembly and the tibia pad assembly are secured to the popliteal pad assembly by use of telescoping tubes which are locked into receiving tubes in the popliteal pad assembly.

7 Claims, 11 Drawing Figures

LEG STABILIZATION FOR A TRUNK EXTENSION/FLEXION TEST, REHABILITATION AND EXERCISE MACHINE

FIELD OF THE INVENTION

This invention relates to a leg stabilization apparatus for a trunk extension/flexion test, rehabilitation and exercise machine wherein a person secured to an input assembly of the machine engages in trunk extension/-flexion motion.

BACKGROUND OF THE INVENTION

In order to be able to effectively test, rehabilitate and exercise a person's back musculature involved in trunk extension/flexion motion, it is important to prevent motion by muscle groups other than the back musculature which performs the trunk extension/flexion motion. Specifically, if the legs are not stabilized, it is impossible to determine the range of motion traversed by the trunk in the trunk extension/flexion motion. Also, if the legs are free to move during the trunk extension/-flexion test, rehabilitation or exercise procedure, an appreciable amount of force could be produced by the lower body in the movement, making it impossible to measure in isolation the strength of the trunk musculature in the trunk extension/flexion motion.

Presently, leg straps are used for leg stabilization on trunk extension/flexion machines. These leg straps have proved to be unacceptable for a number of reasons. First, leg straps are not rigid enough to provide the degree of stabilization required. Also, leg straps are not comfortable for the person, and such discomfort will discourage the person from exerting the maximum trunk extension/flexion force possible and also will discourage the person from extending or flexing the trunk to the full range of motion. Stabilization using leg straps has the additional disadvantage of not being able to be easily and quickly accomplished. Further, the stabilization of the legs by leg straps is not reproducible in that the stabilization provided by leg straps differs from procedure to procedure, making it virtually impossible to make comparative measurements of a person's trunk musculature strength and trunk extension/-flexion range of motion from one procedure to another.

SUMMARY OF THE INVENTION

The present invention is for a leg stabilization apparatus for a test, rehabilitation and exercise machine for stabilizing the legs of a person secured in the machine.

The leg stabilization apparatus has a popliteal pad assembly movably attached to a frame of the machine wherein the height of the popliteal pad assembly can be adjusted so that popliteal pads of the popliteal pad assembly are against the back of the knees of the person. A rack and pinion drive is used to make the height adjustment of the popliteal pad assembly.

The popliteal pad assembly has a top receiving tube and a bottom receiving tube designed to receive a thigh-knee telescoping tube of a thigh-knee pad assembly and a tibia telescoping tube of a tibia pad assembly, respectively. The thigh-knee pad assembly has two thigh pads for placement against the thighs and two knee pads for placement inside the legs against the knees.

To secure the thigh-knee pad assembly to the popliteal pad assembly the thigh-knee telescoping tube is inserted into the top receiving tube of the popliteal pad assembly. When the thigh pads and the knee pads are tightly against the thighs and the inside of the legs at the knees, respectively, a toggle clamp on the thigh-knee pad assembly is then placed in a locked position securing the thigh-knee pad assembly to the popliteal pad assembly.

To secure the tibia pad assembly to the popliteal pad assembly the tibia telescoping tube is inserted into the top receiving tube of the popliteal pad assembly. When the tibia pads are tightly against the thighs, a toggle clamp on the tibia pad assembly is then placed in a locked position securing the tibia pad assembly to the popliteal pad assembly.

DETAILED DESCRIPTION OF THE INVENTION

Figure 1:
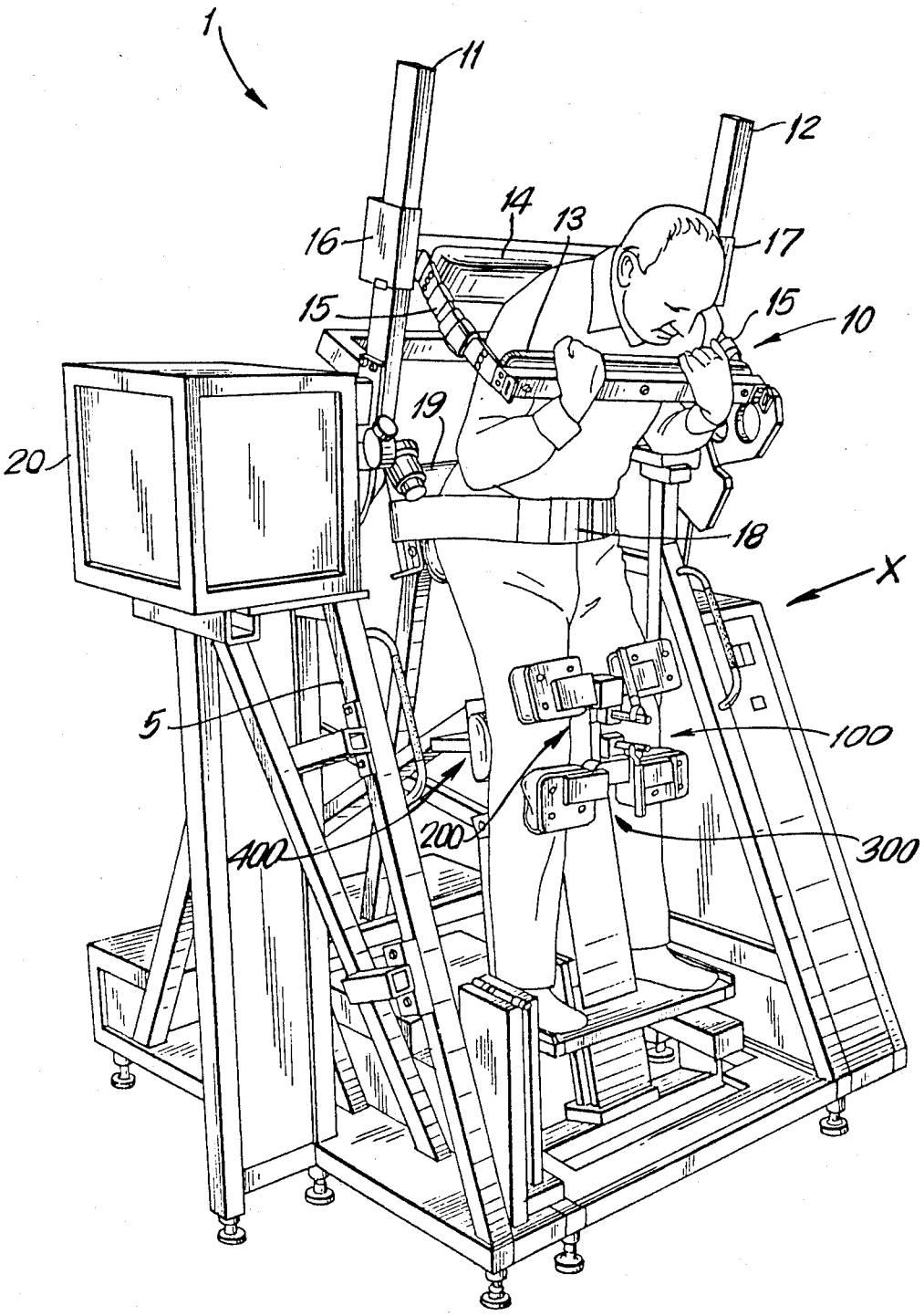
FIG. 1 is a perspective view of a trunk extension/-flexion test, rehabilitation and exercise machine which contains a leg stabilization apparatus of the present invention wherein a person who is secured in an input assembly of the machine is in a bent over or trunk flexion position.
Figure 2:
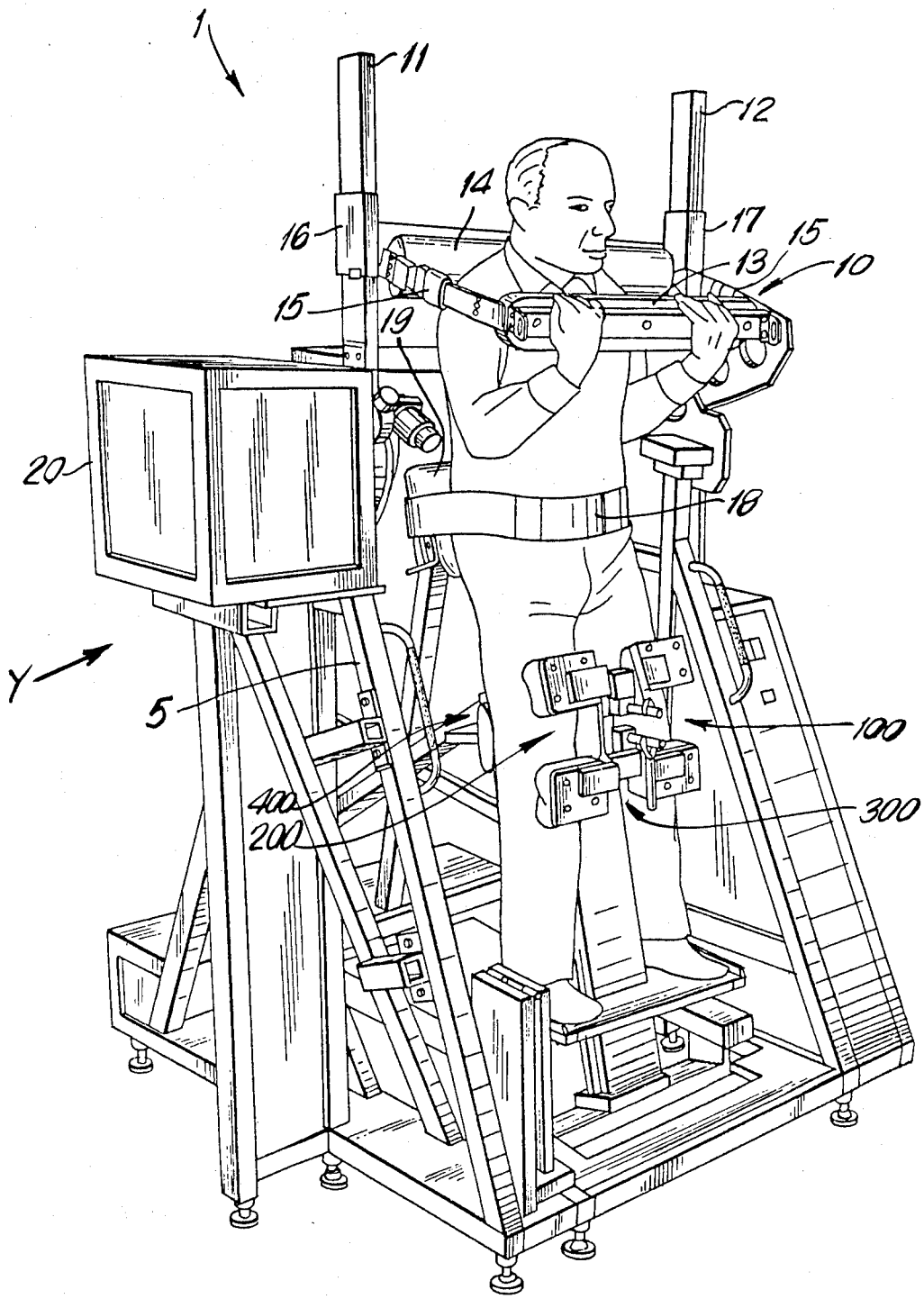
FIG. 2 is another perspective view of the trunk extension/flexion machine of FIG. 1 wherein the person is in a straight up or trunk extension position.

A trunk extension/flexion test, rehabilitation and exercise machine 1 which contains a leg stabilization apparatus 100 of the present invention is shown in FIGS. 1 and 2. The machine 1 is designed for the testing, rehabilitation and exercise of the trunk musculature used in trunk extension and trunk flexion movement. FIG. 1 shows a person secured to the machine 1 wherein the person is in the trunk flexion or bent at the waist position. FIG. 2 shows the person secured to the machine 1 wherein the person is in the trunk extension or straight up position.

An input assembly 10 of the machine 1, which includes two input arms 11 and 12, a chest pad 13 and a scapula pad 14, as shown in FIGS. 1 and 2, rotates downwardly when the person engages in trunk flexion movement and rotates upwardly when the person engages in trunk extension movement. A trunk flexion movement is movement from the position shown in FIG. 2 to the position shown in FIG. 1. A trunk extension movement is movement from the position shown in FIG. 1 to the position shown in FIG. 2.

The person is secured at the waist in the machine 1 by a pelvic strap 18 as shown in FIGS. 1 and 2. The lower back of the person rests against a back pad 19. The legs are stabilized by the leg stabilization apparatus 100 of the present invention.

As shown in FIGS. 1 and 2, the chest pad 13 of the input assembly 10 bears against the chest of the person and the scapula pad 14 bears against the scapula. The chest pad 13 is attached to the scapula pad 14 by belts 15. The scapula pad 14 is attached to slide blocks 16 and 17 which slide over input arms 11 and 12 respectively. Slide blocks 16 and 17 are locked at any desired vertical position on input arms 11 and 12 using a suitable locking means such as toggle clamps (not shown).

The input assembly 10 is rotatably attached to a frame 5 of the machine 1 such that the input assembly 10 will rotate upwardly in relation to the frame 5 when the person engages in trunk extension movement and will rotate downwardly in relation to the frame 5 when the person engages in trunk flexion movement.

An isokinetic dynamometer (not shown), which is mechanically connected to the input assembly 10, measures the force which the person is able to exert in trunk flexion movement and in trunk extension movement. The dynamometer operates on the well-known theory of isokinetics whereby the rotational speed of the input assembly 10 cannot exceed a pre-determined limit. The pre-determined rotational speed of the input assembly 10 is set by making a selection from dynamometer controls (not shown) on the dynamometer.

The general theory of isokinetics is described in U.S. Pat. No. 3,465,592 issued to J. J. Perrine on Sept. 9, 1969. The description of isokinetics contained in that patent is incorporated herein by reference.

Until such time as the person exerts a force on the chest pad 15 or the scapula pad 14 sufficient to make the input assembly 10 rotate at the pre-determined speed, the person will not feel any resistive force. However, any attempt by the person to accelerate the input assembly 10 beyond the pre-determined speed results in the dynamometer providing an accommodating, resistive force equal to the force exerted by the person. Therefore, the person cannot make the input assembly 10 rotate any faster than the pre-determined set speed, and any increased force exerted by the person is met by an equal accommodating, resistive force from the dynamometer.

The isokinetic dynamometer in the present embodiment is similar to the dynamometer which is available as part of the Cybex® II+ test, rehabilitation and exercise machine, which is manufactured and sold by the Cybex Division of Lumex Inc., 2100 Smithtown Avenue, Ronkonkoma, N. Y.

Since the dynamometer provides an accommodating, resistive force equal to the force exerted by the person, measurement of the force provided by the dynamometer is also a measurement of the strength of the person's trunk musculature through the trunk extension and trunk flexion movements. A computer (not shown) can be used to record this measurement and process a group of measurements for further analysis of the person's progress during the test, rehabilitation or exercise procedure.

In the present embodiment, the isokinetic dynamometer is located in a dynamometer enclosure 20. The dynamometer enclosure 20 is rigidly attached to the frame 5 of the machine 1.

The leg stabilization apparatus 100 of the present invention is shown in detail in FIGS. 3–9.

The popliteal pad assembly 400 is shown in FIGS. 3, 3A 4, 4A and 5. The popliteal pad assembly 400 includes two popliteal pads 410 and 420, a top receiving tube 430, a bottom receiving tube 440, a popliteal pad support structure 450, a rack and pinion drive 460, and a knob 470.

Figure 3:
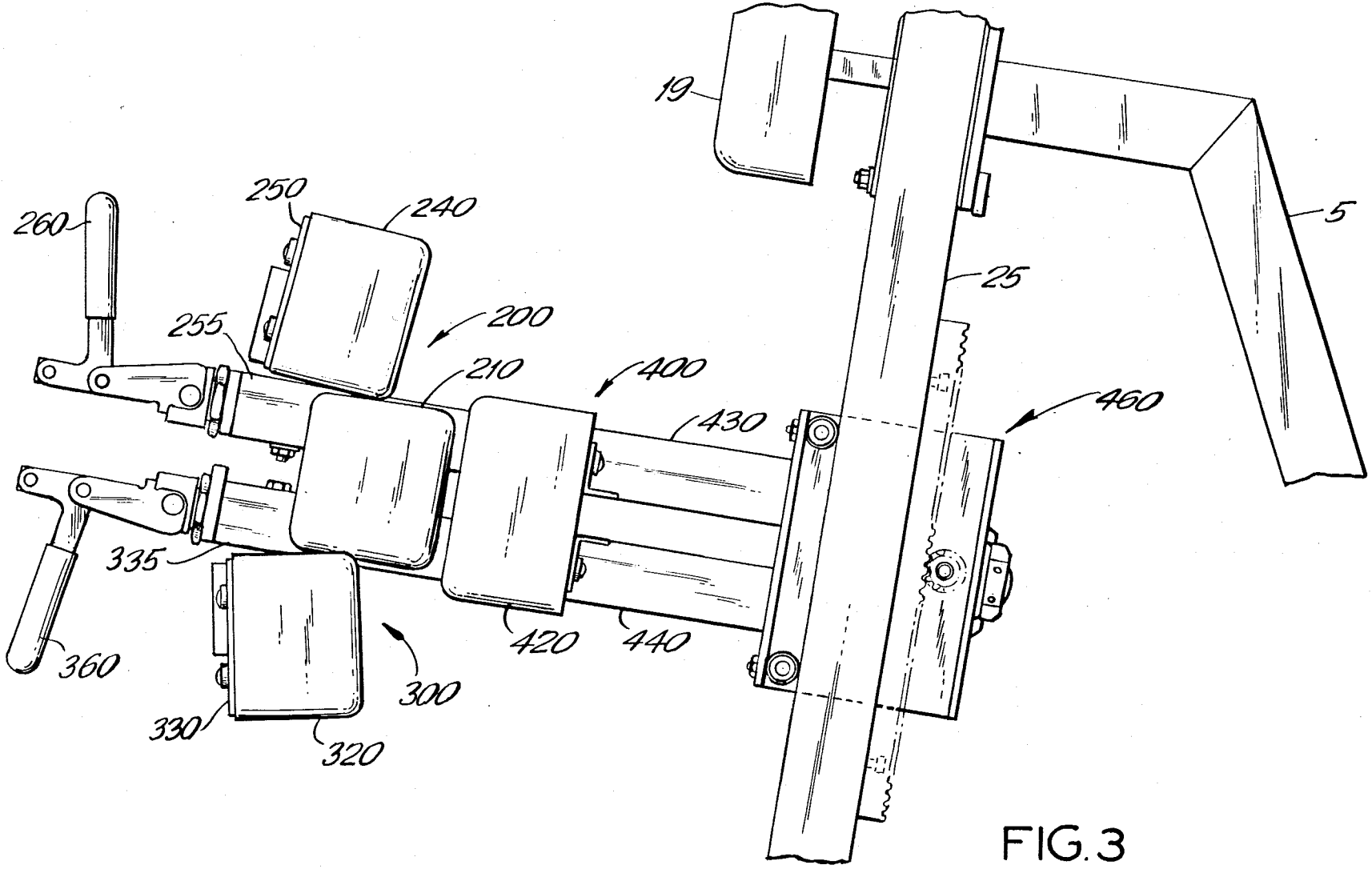
FIG. 3 is a partial side elevational view of the machine of FIG. 2 along the direction of arrow x of FIG. 1 showing a portion of the leg stabilization apparatus of the present invention.
Figure 3A:
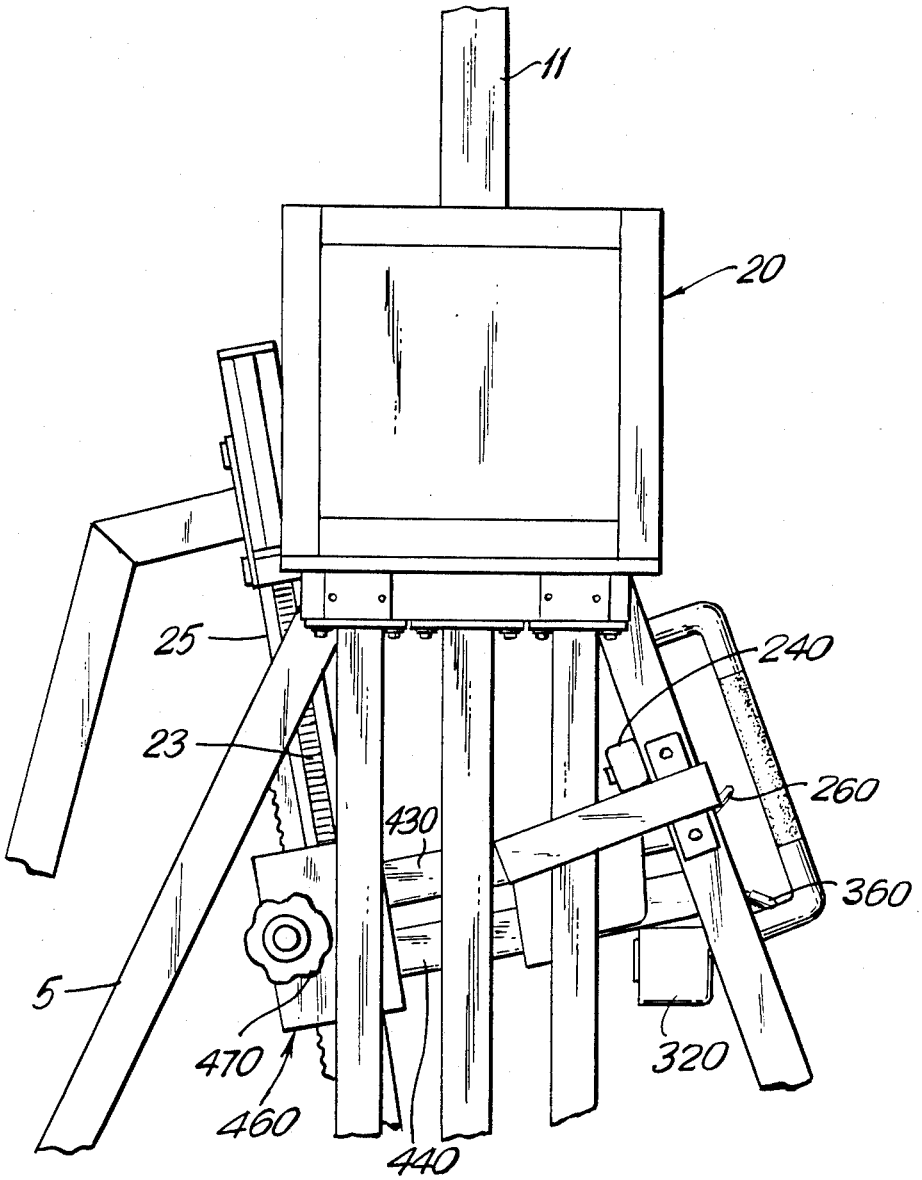
FIG. 3A is a partial side elevational view of the machine of FIG. 2 along the direction of arrow y of FIG. 2 showing a portion of the leg stabilization apparatus of the present invention.
Figure 4:
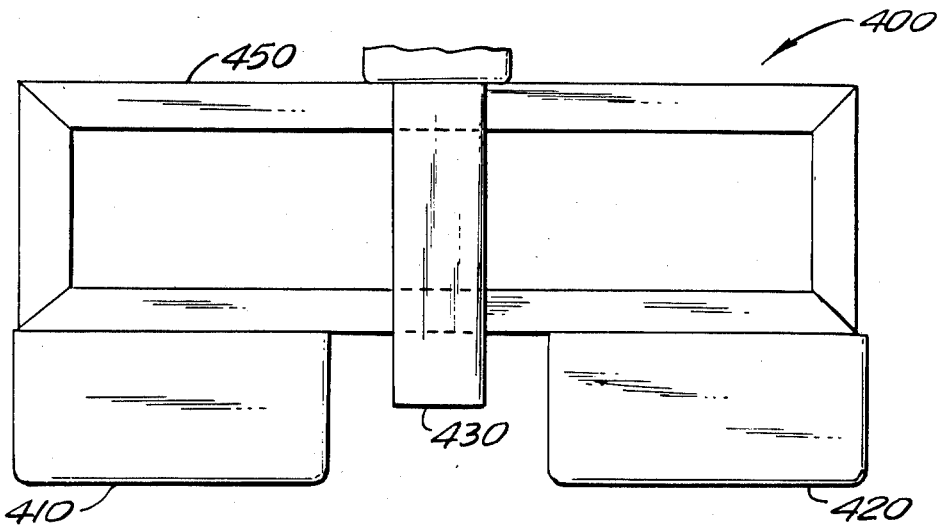
FIG. 4 is a simplified partial top view of a popliteal pad assembly of the present invention.
Figure 4A:
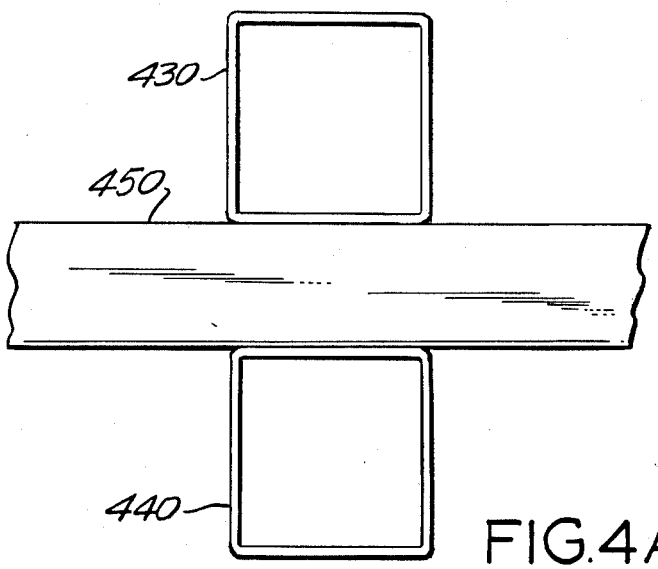
FIG. 4A is a simplified front partial front elevational view of the popliteal pad assembly of the present invention.
Figure 5:
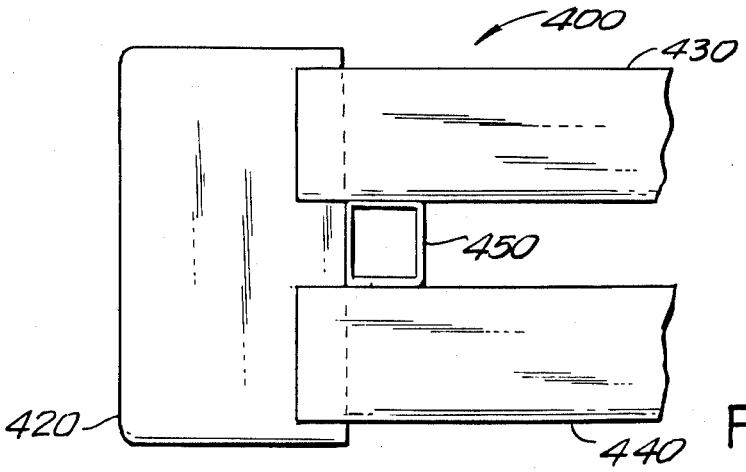
FIG. 5 is a simplified partial side elevational view of FIG. 4.

As shown in FIGS. 3 and 3A, the rack and pinion drive 460 is mounted on a beam 25 of the frame 5 of the machine 1. The popliteal pad support structure 450 is rigidly attached to the rack and pinion drive 460. The popliteal pads 410 and 420 are rigidly attached to the popliteal pad support structure 450. The top receiving tube 430 and the bottom receiving tube 440 are also each rigidly attached to the popliteal pad support structure 450.

As shown in FIG. 3A, the rack and pinion drive 460 rides on the beam 25 of the frame 5 of the machine 1. To adjust the vertical position of the popliteal pad assembly 400 on the beam 25 so that the popliteal pads 410 and 420 bear against the back of the person's knees, the operator of the machine 1 pushes in the knob 470. The knob 470 is connected to the rack and pinion drive 460 in such a manner that pushing in the knob 470 releases a lock on the rack and pinion drive 460 and turning the knob 470 clockwise or counterclockwise raises or lowers, respectively, the popliteal pad assembly 400 on the beam 25. The rack and pinion drive 460 in the present embodiment is of conventional construction.

When the operator has moved the popliteal pad assembly 400 to the desired position on the beam 25, he releases the knob 470, causing a spring (not shown) to force the rack and pinion drive 460 to lock at that position. The operator can note the position of the popliteal pad assembly 400 on the beam 25 by referring to a position label 23 mounted on the beam 25 as shown in FIG. 3A.

As described below, the top receiving tube 430 of the popliteal pad assembly 400 receives a thigh-knee pad telescoping tube 255 of the thigh-knee pad assembly 200 and the bottom receiving tube 440 of the popliteal pad assembly 400 receives a tibia telescoping tube 335 of the tibia pad assembly 300.

Figure 7:
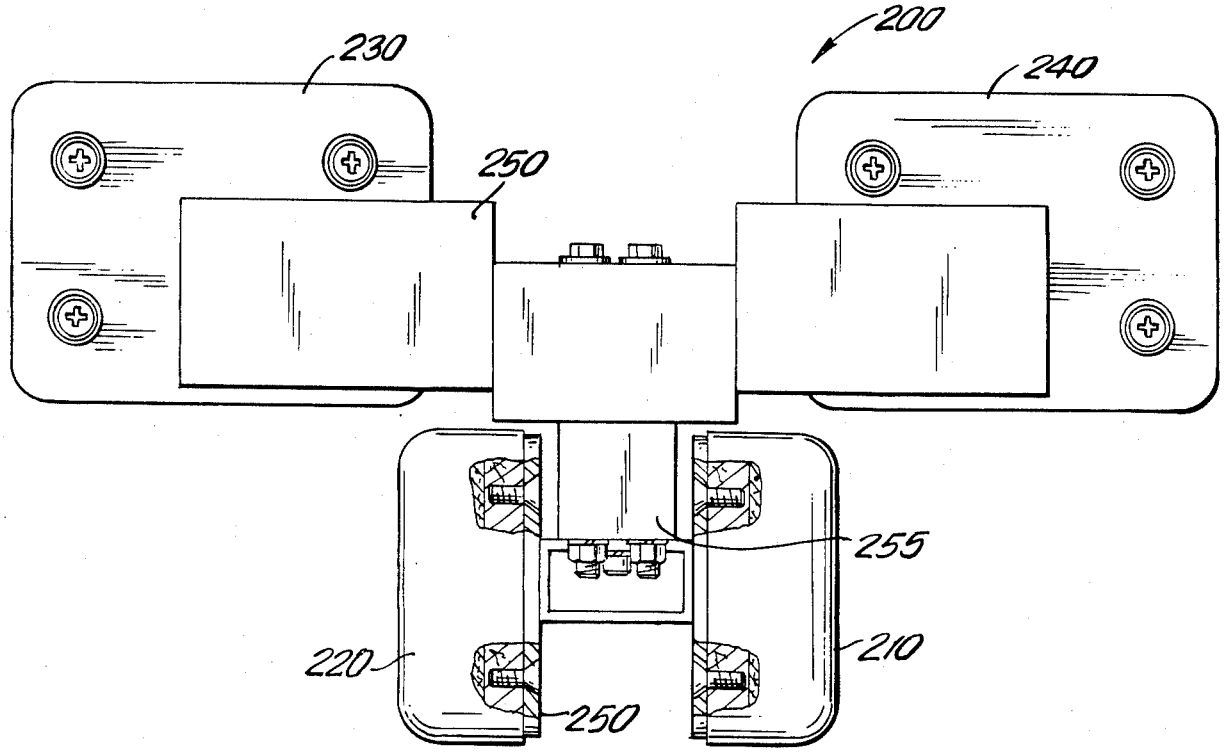
FIG. 7 is a front elevational view of the thigh-knee pad assembly of FIG. 6 wherein a toggle clamp of the thigh-knee pad assembly is not shown.

The thigh-knee pad assembly 200, as best seen in FIGS. 1, 2 and 7, has four pads, two of which bear against the thighs and two of which bear against the inside of the legs at the knees. The knee pads 210 and 220 and the thigh pads 230 and 240 are each rigidly attached to a thigh-knee pad support structure 250. A thigh-knee telescoping tube 255 is part of the thigh-knee pad support structure 250.

After the popliteal pad assembly 400 is positioned on the beam 25 at the desired height so that the popliteal pads 410 and 420 are directly behind the knees, the thigh-knee pad assembly 200 is secured to the popliteal pad assembly 400 in the following manner. First, an end 258 of the thigh-knee telescoping tube 255 is inserted into the top receiving tube 430 of the popliteal pad assembly 400. The operator pushes the thigh-knee pad assembly 200 tightly against the person so that the thigh pads 230 and 240 are bearing against the thighs and the knee pads 210 and 220 are bearing against the inside of the knees. To lock the thigh-knee pad assembly 200, the operator rotates the toggle clamp 260 upwardly to the locked position shown in FIGS. 1, 2 and and 6. This causes a rod 254 in the tube 255 to compress a polyurethane locking plug 270 at the end 258 of the thigh-knee telescoping tube 255. At one end the rod 254 is connected to the polyurethane locking plug 270 and at the other end to the toggle clamp 260. As the polyurethane locking plug 270 is compressed, it expands outwardly inside the top receiving tube 430 of the popliteal pad assembly 400, thus rigidly securing the telescoping tube 255 in the top receiving tube 430. The thigh-knee pad assembly 200 is now secured and cannot move in any direction.

Figure 6:
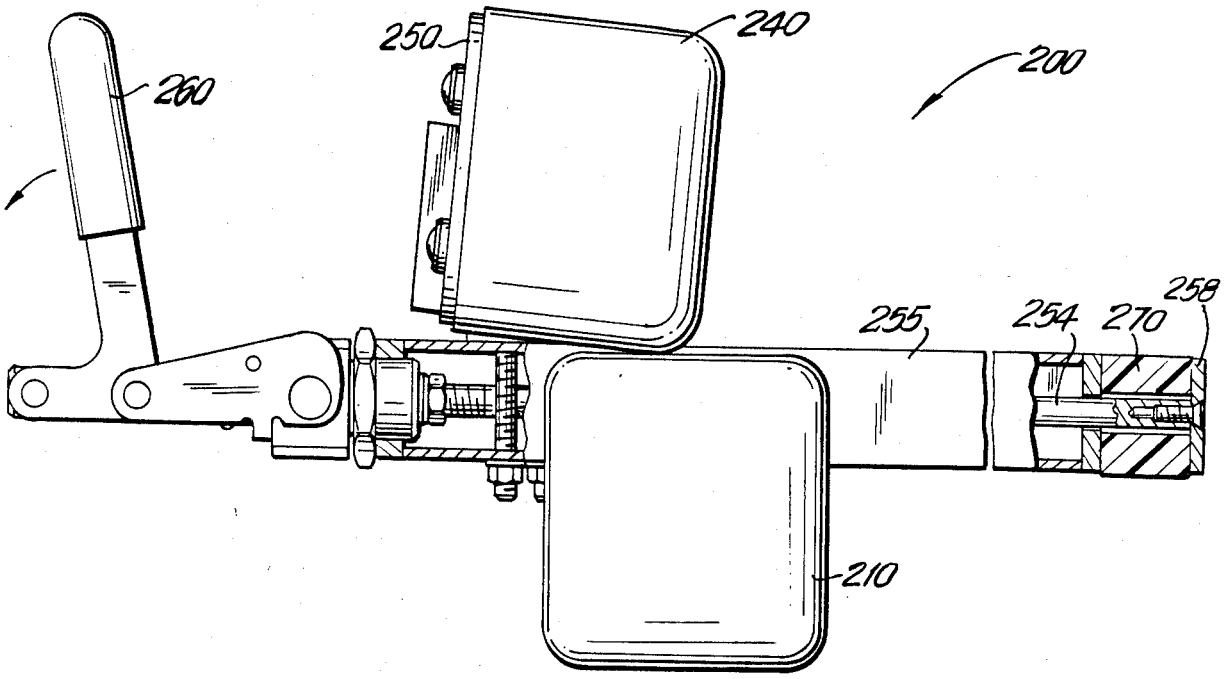
FIG. 6 is a side elevational view partly in section of a thigh-knee pad assembly of the present invention.

To remove the thigh-knee pad assembly 200, the operator rotates the toggle clamp 260 downwardly in the direction of the arrow of FIG. 6. This causes the rod 254 to move away from the polyurethane locking plug 270. The polyurethane locking plug 270 then contracts within the top receiving tube 430, thus permitting the operator to remove the telescoping tube 255 from the top receiving tube 430.

Figure 8:
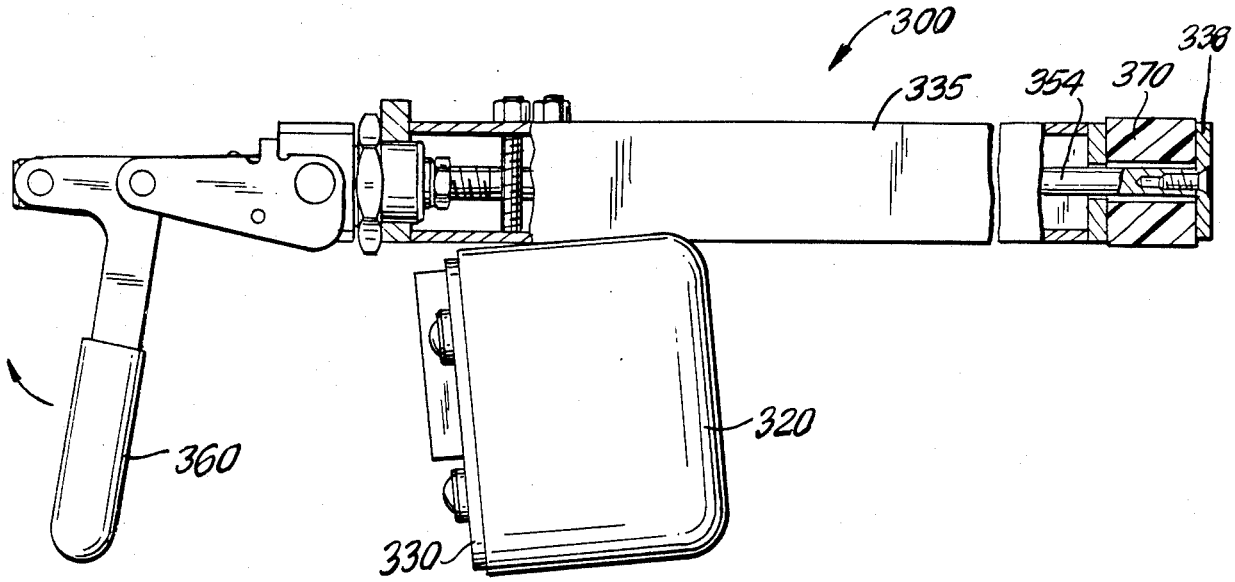
FIG. 8 is a side elevational view partly in section of a tibia pad assembly of the present invention.
Figure 9:
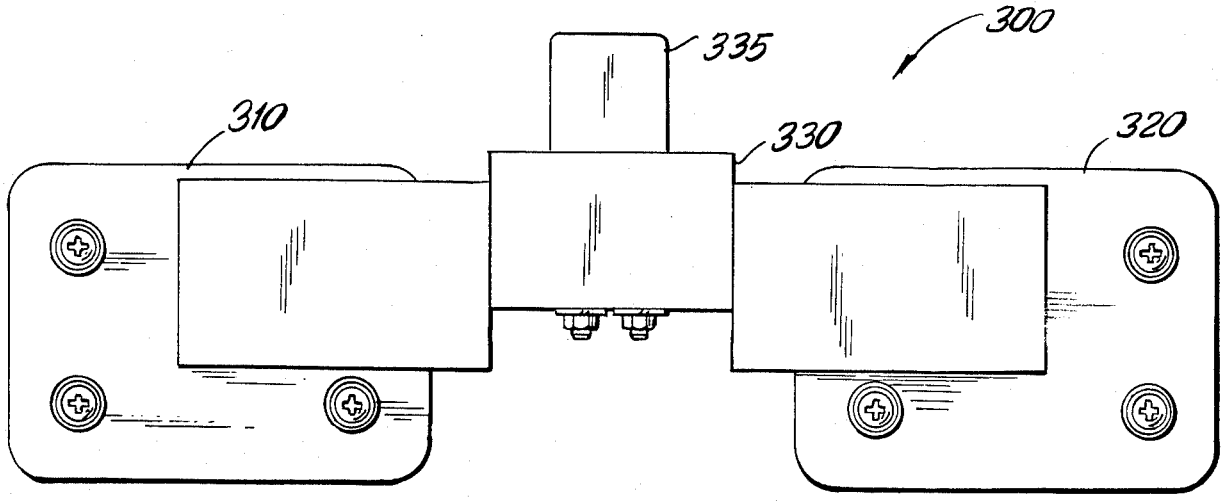
FIG. 9 is a front elevational view of the tibia pad assembly of FIG. 8 wherein a toggle clamp of the tibia pad assembly is not shown.

The tibia pad assembly 300, shown in FIGS. 8 and 9, has two tibia pads 310 and 320 which bear against the tibia. The tibia pads 310 and 320 are rigidly attached to a tibia pad support structure 330. A tibia telescoping tube 335 is part of the tibia pad support structure 330. An end 338 of the tibia telescoping tube 335 has a polyurethane locking plug 370 similar to the locking plug 270 of the thigh-knee pad assembly 200 a described above.

To assemble the tibia pad assembly 300 the operator inserts the tibia telescoping tube 335 into the bottom receiving tube 440 of the popliteal pad assembly 400. The operator pushes the tibia pad assembly 300 tightly against the person so that the tibia pads 310 and 320 are bearing against the tibia as shown in FIGS. 1 and 2. To lock the tibia pad assembly 300, the operator rotates the toggle clamp 360 downwardly to the position shown in FIGS. 1, 2 and and 8. This causes a rod 354 in the tube 335 to compress the polyurethane locking plug 370 at the end 338 of the tibia telescoping tube 335. At one end the rod 354 is connected to the polyurethane locking plug 370 and at the other end to the toggle clamp 360. As the polyurethane locking plug 370 is compressed, it expands outwardly inside the bottom receiving tube 440 of the popliteal pad assembly 400, thus rigidly securing the tibia telescoping tube 335 in the bottom receiving tube 440. The tibia pad assembly 300 is now secured and cannot move in any direction.

To remove the tibia pad assembly 300, the operator rotates the toggle clamp 360 upwardly in the direction of the arrow of FIG. 8. This causes the rod 354 to move away from the polyurethane locking plug 370. The polyurethane locking plug 370 contracts within the top receiving tube 440, thus permitting the operator to remove the telescoping tube 335 from the bottom receiving tube 440.

Until the assemblies 200 and 300 are secured to the popliteal pad assembly 400, the person is supporting his or her body weight with muscles in the hip and legs. However, after the thigh-knee pad assembly 200 and the tibia pad assembly 300 are secured to the popliteal pad assembly 400 as described above, the person can relax because the leg stabilization apparatus 100 supports the body weight of the patient. This makes the leg stabilization apparatus 100 very comfortable in a manner not found when leg straps are used for leg stabilization.

The popliteal pad assembly 400, the thigh-knee pad assembly 200 and the tibia pad assembly 300 provide the stabilization required to prevent the legs of the person from moving during the test, rehabilitation and exercise procedure, thus permitting the dynamometer to measure in isolation the strength of the trunk musculature in trun extension/flexion movement. Also, the apparatus 100 of the present invention, when in place, supports the body weight of the person, allowing the person to relax.

Further, the leg stabilization apparatus 100 of the present invention forces the person into a limited degree of knee flexion. Knee flexion allivates some of the stretch on the hamstrings, reducing the effect tight hamstrings would have on the person's trunk flexion range of motion, and thus permits the person to engage in the greatest trunk flexion range of motion possible.

Because the leg stabilization apparatus 100 of the present invention is very comfortable, the person in the machine 1 will not be inhibited in his or her trunk extension or trunk flexion movement, and will be able to exert full trunk musculature rotational force in the movement.

The stabilization provided by the leg stabilization apparatus 100 of the present invention has the additional advantage in that it is reproducible, i.e., the leg stabilization can be duplicated next time the person uses the machine 1 for further testing, rehabilitation or exercise procedure.

It is to be understood that the leg stabilization apparatus of the present invention could be used on a test, rehabilitation or exercise machine other than the trunk extension/flexion machine 1 described above.

Applicant's invention is not limited to the embodiment of the leg stabilization apparatus described above. It is further understood that applicant's invention is as set forth in the following claims.

We claim:

1. A leg stabilization apparatus on a test, rehabilitation or exercise machine for stabilizing the legs of a person secured in an upright position in the machine comprising:

a popliteal pad assembly including popliteal pads;

means for securing the popliteal pads to a frame of the machine in a position such that the limb engaging portion of said popliteal pads lies in a substantially vertical plane for placement against the back of the knees when the person is in the upright position, causing a limited degree of knee flexion;

thigh pads for placement against the distal portion of the thighs to prevent inferior motion of the pelvis when the person is in the upright position;

means for securing the thigh pads to the popliteal pad assembly such that the thigh pads are positioned generally above the popliteal pads, while the limb engaging portion of said thigh pads lies in a substantially vertical plane and faces the limb engaging portion of said popliteal pads;

knee pads for placement against the inside of the knees when the person is in the upright position;

means for securing the knee pads to the popliteal pad assembly such that the pads are located generally between the popliteal pads, wherein the knee pads keep the person's knees apart when the person is stabilized in the leg stabilization apparatus;

tibia pads for placement against the tibia to prevent inferior motion of the pelivs when the person is in the upright position; and means for securing the tibia pads to the popliteal pad assembly such that the tibia pads are positioned generally below the popliteal pads, while the limb engaging portion of said tibia pads lies in a substantially vertical plane and faces the limb engaging portion of said popliteal pads, wherein neither the thigh pads nor the tibia pads bear directly against the front of the person's knees and the body weight of the person is supported by the leg stabilization apparatus.

2. The leg stabilization apparatus of claim 1 also comprising means for adjusting the height of the popliteal pad assembly on the frame of the machine.

3. The leg stabilization apparatus of claim 2 wherein the adjusting means comprises a rack and pinion drive.

4. The leg stabilization apparatus of claim 1 wherein the knee pads and the thigh pads are rigidly attached to a thigh-knee pad support structure and the tibia pads are rigidly attached to a tibia pad support structure wherein the popliteal pad assembly also comprises a top receiving tube and a bottom receiving tube for receiving a thigh-knee pad telescoping tube and a tibia telescoping tube, respectively, the top receiving tube and the bottom receiving tube arranged in parallel relation, wherein the thigh-knee telescoping tube is rigidly attached to the thigh-knee pad support structure and the tibia telescoping tube is rigidly attached to the tibia pad support structure.

5. The leg stabilization apparatus of claim 4 wherein the means for securing the thigh pads and the knee pads to the popliteal pad assembly comprises a locking plug at an end of the thigh-knee telescoping tube, a rod in the thigh-knee telescoping tube attached at one end to the locking plug and a toggle clamp attached to the other end of the rod wherein the rod compresses the locking plug when the toggle clamp is placed in a locked position, causing the locking plug to expand within the top receiving tube of the popliteal pad assembly and securing the thigh-knee telescoping tube in the top receiving tube.

6. The leg stabilization apparatus of claim 4 wherein the means for securing the tibia pads to the popliteal pad assembly comprises a locking plug at an end of the tibia telescoping tube, a rod in the tibia telescoping tube attached at one end to the locking plug and a toggle clamp attached to the other end of the rod wherein the rod compresses the locking plug when the toggle clamp is placed in a locked position, causing the locking plug to expand within the bottom receiving tube of the popliteal pad assembly and securing the thigh-knee telescoping tube in the top receiving tube.

7. The leg stabilization of claim 2 also comprising means for determining the vertical position of the popliteal pad assembly relative to the frame of the machine.

* * * * *